United States Patent [19]

Thompson et al.

[11] Patent Number: 4,845,370

[45] Date of Patent: Jul. 4, 1989

[54] MAGNETIC FIELD FORMER FOR CHARGED PARTICLE BEAMS

[75] Inventors: Chester C. Thompson, Roslyn Heights; Raymond J. Loby, Plainview, both of N.Y.

[73] Assignee: Radiation Dynamics, Inc., Melville, N.Y.

[21] Appl. No.: 131,676

[22] Filed: Dec. 11, 1987

[51] Int. Cl.[4] ..... H01J 33/02

[52] U.S. Cl. ..... 250/492.3; 250/396 ML; 250/398; 250/397

[58] Field of Search ..... 250/492.3, 396 ML, 398, 250/397

[56] References Cited

U.S. PATENT DOCUMENTS

| | | | |
|---|---|---|---|
| 2,602,751 | 7/1952 | Robinson | 250/492.3 |
| 2,897,365 | 7/1959 | Dewey et al. | 250/400 |
| 2,941,077 | 6/1960 | Marker | 250/396 R |
| 2,993,120 | 7/1961 | Emanuelson | 250/492.3 |
| 3,833,814 | 9/1974 | Nablo | 250/492.1 |
| 3,857,034 | 12/1974 | Hoppe | 250/311 |
| 3,857,090 | 12/1974 | Chick | 250/397 |
| 3,942,017 | 3/1976 | Uehara et al. | 250/492.3 |
| 4,075,496 | 2/1978 | Uehara | 250/492.3 |
| 4,169,230 | 9/1979 | Bohlen et al. | 250/492.2 |
| 4,201,920 | 5/1980 | Levaillant | 250/492.3 |
| 4,223,200 | 9/1980 | Moench et al. | 219/121 EB |

*Primary Examiner*—Jack I. Berman

*Attorney, Agent, or Firm*—Shlesinger & Myers

[57] ABSTRACT

Provided herein is an electro-magnetic field former for controlling charged particle trajectories in a scanning charge particle source including a pair of induction coils and C-shaped ferromagnetic yokes which are positioned in the air space between the particle source and a target at the target edges to normalize the angle of incidence of the particles relatve to the target and to deflect scattered particles into the target edges. Also provided is a field former controller to compensate for induced flux variations caused by an oscillating particle beam.

19 Claims, 4 Drawing Sheets

MAGNETIC FIELD FORMER FOR CHARGED PARTICLE BEAMS

FIELD OF THE INVENTION

This invention relates to material irradiation control and charged particle beam technology and, more particularly, to an electro-magnet with an air gap disposed proximate to the space between a charged particle source and a target for normalizing the angle of incidence of the beam relative to and deflecting the scattered particles to the target surface, and a controller to compensate for flux generated by the charged particles.

BACKGROUND OF THE INVENTION

In a discipline of sheet material irradiation, particularly with an electron beam, uniform beam and dose distribution across the entire surface is critical to achieve uniform product characteristics. Since the advent of charged particle and, especially, electron beam treatment of material, many devices and improvements thereon have been introduced to promote beam distribution control to achieve radiation dose uniformity. The first true advance involved controlled oscillatory scanning of the beam, exemplified in Robinson, U.S. Pat. No. 2,602,751. Although greatly enhancing the usefulness of scanning technology, problems with product uniformity still existed. Generally, these problems resulted from beam scanning geometries. In order to promote greater uniformity, adjunct devices were subsequently introduced. Such devices include reflected beam techniques such as that exemplified by Yehara, U.S. Pat. No. 3,942,017, deflecting scatter plates (see Robinson above), as well as a host of target product manipulation devices that move and twist the target relative to the scanning beam. Referring particularly to target product manipulation, the complex equipment employed is subject to mechanical breakdown and wear. Thus, serious maintenance problems arise, especially when breakdown occurs during processing. Not only must production be interrupted but also a significant quantity of target product may be lost.

Turning now to beam distribution control devices, although they enhance target product dosage uniformity, they often fail to achieve the objective of substantially ideal uniformity. Uniform dosage distribution is a function, both of the target material's dose tolerance and of the scanned beam characteristics. It is well known in the art that surface dose uniformity of an electron beam degrades as energies decrease. Hence, at beam energies under 1 MeV and, more particularly, at 300–400 KeV, a 5% or more variation of dosage uniformity is generally observable. This loss of uniformity results from the intensity loss of electrons upon passage through the electron beam's source window (generally formed from titanium foil and the like) compounded by the diminished scattered electrons impingement at the scan boundaries.

Referring first to the intensity loss, the apparent thickness of the beam source window and air space between the window and target progressively increases toward the boundaries of the scan angle. Although generally constructed to possess a minimum thickness, electron scattering is generated both by the window and by the depth of the atmosphere between the window and target product surface. Basically, the greater the apparent thickness, the greater the degree of electron scatter and the greater the loss of beam dosage intensity along the scan boundaries. This loss is easily expressed by a simple arithmetic proportionality:

$$\text{intensity} \approx 1/\cos \alpha$$

where $\alpha$ equals the scan angle at a given point. Hence, as the beam is scanned across the entire product path, electron scatter increases from a minimum at a normal angle of incidence to a maximum at the sweep angle boundaries. Conventionally, the product edges correspond with the scan boundary. Thus, the increase in scattering results in an effective dosage loss and corresponding reduced product irradiation uniformity at the product edges.

The second major contribution to the non-uniform target exposure from the increasing apparent thickness, particularly in the case of flat or sheet-like material, is the loss of dosage intensity from scattered electrons. As identified above, as the beam approaches the product edge (scan boundary), the apparent thickness of the window and air space between the window and material increases. Scattering is particularly detectable with beams having energies under 1 MeV. A measurable portion of electrons scattered by the window and air gap during scanning, impinge on the product peripheral to the primary beam. However, at the edge of the target, such scattered electrons will impinge on air or a surface adjacent to the product. Thus, the edges of the target do not receive reinforced electron scatter from the beam as it moves progressively across the target and the contribution to actual dosage will be absent at the target edges.

This phenomenon has been recognized in the art and has been addressed by use of corrective adjunctive equipment, the most common being the use of electrified scatter plates and wedge magnets. In the case of electrified scatter plates, the primary electron beam impinges on a plate positioned below a scan horn window causing the generation of secondary electrons (see FIG. 2). A portion of the secondary electrons which are released from the scatter plate isotropically, impinge upon the product edges and provide a corresponding increase in product edge irradiation and, hence, product uniformity. Although generally acceptable, the technique suffers from the shortcoming of producing secondary electrons that scatter in all directions from the scatter plate. More importantly, secondary electrons generated by the scatter plate method do not possess the same energy as the primary electrons thereby resulting in a lesser degree of penetration of those electrons at the product edges. Therefore, ideal uniformity is not achieved.

The use of wedge magnets positioned peripherically within the scan horn and immediately above the window (see FIG. 3 herein), the second principal conventional corrective technique to provide increased beam uniformity, is clearly illustrated in U.S. Pat. No. 2,993,120 to Emanuelson. The magnets generate magnetic flux in the scan horn base corresponding with the height of the magnet. The wedge magnets technique is intended to produce a minimal transverse magnetic field at the center of the scan horn (minimal height) corresponding with a normalized electron beam and progressively increased intensity toward the scan periphery (maximum magnet height). This technique overcomes the problem of energy loss associated with the scatter plate apparatus but does not solve the electron scatter problem at the target edges as identified above. Hence, the target product edges are still deprived of an equivalent amount of irradiation as compared to the center portion of the target product. The foregoing techniques share the common problem of failing to achieve uniform product irradiation due to non-uniform beam distribution and non-uniform particle scatter across the entire scan.

SUMMARY OF THE INVENTION

It is an object of this invention to overcome the identified problems with prior art devices relating to irradiation beams.

It is another object of this invention to induce enhanced uniformity of products produced by a scanning charge particle beam.

It is another object of this invention to provide a simple and elegant apparatus with a minimum of components.

Still another object of this invention is to provide an apparatus which both normalizes the angle of incidence of a sweeping charged particle beam onto a target and induces utilization of scattered charged particles at the target edge.

Yet another object of this invention is to provide a magnetic field former readily adapted for electron beam product irradiation technology.

Another object of this invention is to provide a control means for compensating for magnetic flux induced in a magnetic field former by the sweeping of a charged particle beam.

These and other objects are satisfied by a charged particle apparatus for charged particle exposure of selected targets including a generating means for generating a beam of charged particles, a window means for sweeping said beam in an oscillatory manner through a plane and over a selected angle sufficient to encompass exposure of the target edges, and an electro-magnetic deflecting means for deflecting the charged particles in the beam and scattered by said window, where the electro-magnetic deflecting means possesses an air gap having a width greater than the width of the beam and the deflecting means is located substantially adjacent to said window and between the window and the target to generate magnetic flux perpendicular to the plane of said particle beam to deflect and normalize the angle of incidence of the particles in said beam which are scattered by said window.

The objects are further satisfied by a magnetic field former in a scanning high energy charged particle apparatus for charged particle exposure of selected targets having outer edges, featuring a generating means for generating a beam of charged particles and means for sweeping the beam in an oscillatory manner through a plane and over a selected angle. The apparatus primarily features two electro-magnetic deflecting means for deflecting the charged particles in the beam as it sweeps across the selected angle, each of the electro-magnetic deflecting means possessing an air gap having a length greater than the width of the beam, each deflecting means being remotely spaced and located at an equal distance from the generating means and substantially adjacent to the target edges, where the magnetic deflecting means is positioned to generate magnetic flux perpendicular to the normalized particle beam. The strength of the flux is inversely proportional to the distance from said magnetic deflecting means. Thus, the magnetic deflecting means normalizes the angle of incidence of the beam of charged particles across the entire sweep angle and deflects scattered electrons at the sweep boundaries into the target edges.

Still further objects of this invention are satisfied by a magnetic field former for control of a charged particle beam, including a particle beam source for generating a particle beam which has a window. A power supply for supplying an electric current to the coil, a magnetized yoke having two arms of a desired length separated by an air gap of a desired width and a base connecting said arms and an inductive coil comprised of a selected number of windings, said coil being electrically connected to said power supply and said coil being positioned around said base between said arms, are provided. The controller also features a voltage amplifier to amplify voltage induced in said coil by said beam, a differential amplifier for generating a reference signal corresponding to the voltage induced by said particle beam in said coil, and finally, means for utilizing said signal to make adjustments based on said reference signal.

The magnetic field former invention provided herein more fully utilizes charged particles, and especially electrons, at the ends of a scan and to promote product irradiation uniformity at the edges of a product corresponding with the ends of a scan. In essence, the invention achieves its intended purposes by providing a pair of electro-magnets having an air gap of sufficient length to create magnetic flux to encompass the scattered electron beam exiting from a conventional scan horn window. When the electro-magnets are properly aligned, the magnetic flux will progressively decrease toward the center line of the scan, i.e. that normal to the product and beam source. The magnetic force generated by the field formers will vary in respect to the reciprocal of the distance from the pole faces thereby inducing the strongest effect at the pole faces while providing decreasing flux density corresponding to the distance from the pole faces. Thus, proper alignment of the magnetic polarity will normalize and deflect electrons emerging from the end of scan horn window into the product edges.

The invention also contemplates a control means to compensate for flux induced by the oscillating charged particle beam on the magnetic field former.

These concepts and the invention will become more clear to the skilled artisan upon careful review of the following detailed description of the invention in the context of an electron beam source.

DETAILED DESCRIPTION OF THE ILLUSTRATED EMBODIMENT

Figure 1:
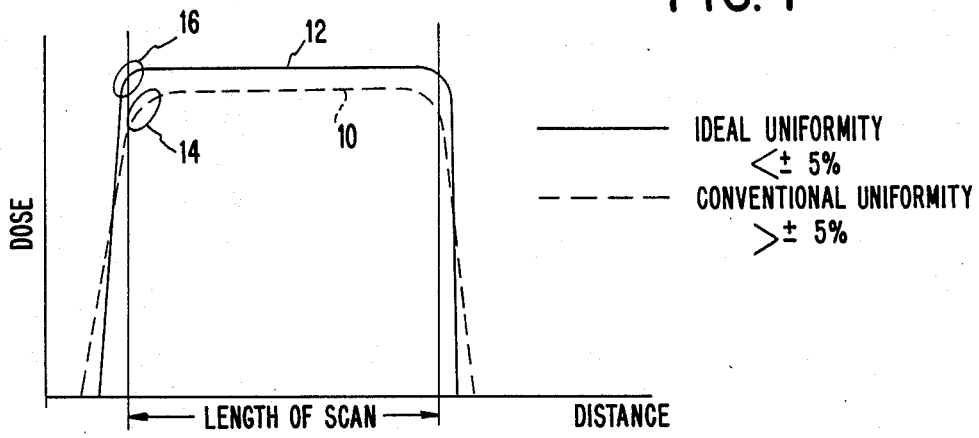
FIG. 1 is a graphic depiction of a dosage uniformity/-curve.

FIG. 1 is presented for summary purposes by providing a graphic understanding of the invention. Dashed line 10, conventional uniformity, is offset for purposes of illustration, only. Its amplitude would otherwise equal that of solid line 12, representing ideal uniformity, and line 10 would substantially overlie line 12. The principal differences between lines 10 and 12 are in regions 14 and 16, respectively. Conventional electron beam scanning equipments provide nearly uniform target exposure across the length of the scan, except at the scan ends. As described above, the edges of sheet-like target will be deprived of an equivalent dosage due to reduced apparent intensity and uncontrolled scatter. Even attempted correction by the now familiar scatter plate or wedge magnet technologies (see FIGS. 2 and 3), fails to cure a substantial loss of dosage, in excess of 5% variation, at the scan periphery which is represented by the gradual curve of line 10 in region 14. In contrast, the instant invention, represented by line 12, avoids such non-uniformity and exhibits the sharp transition in region 16. Hence, the dosage across the entire scan length is of ideal uniformity, i.e. less than 5% variation.

To achieve ideal uniformity (line 12), the instant invention combines two principles of charged particle beam technology. First, the invention normalizes the angle of incidence of primary electrons of the beam relative to the target. The magnetic flux lines alter the radius of curvature of primary electron pathways as a function of the location of those electrons, relative to the scan and target. The second principle involves realignment and effective utilization of electrons scattered by the window and air space at the beam ends. The electrons, as set forth above, would otherwise have a trajectory outside the beam scan and beyond the target edges.

Figure 2:
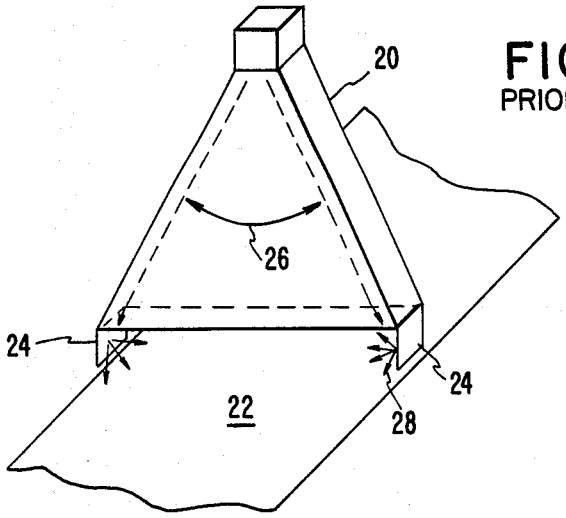
FIG. 2 PRIOR ART
FIG. 2 is a perspective schematic view of a scatter plate type prior art device.
Figure 3:
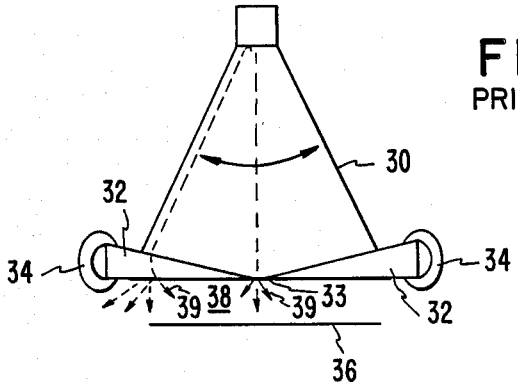
FIG. 3 PRIOR ART
FIG. 3 is a front view of a wedge magnet type prior art device.

The prior art in FIGS. 2 and 3 represent scatter plate and wedge magnet control apparatus, respectively. Scan horn 20 restricts the extent of the oscillatory electron beam sweep 26 for electrons impinging on sheet-like product 22. When the primary electrons emerge from a window (not illustrated) at the base of the horn, the electrons at the sweep periphery impinge on plates 24. Lower energy secondary electrons 28 are then isotropically generated, some of which will penetrate into the target edges. Due to the lower energy of the emitted secondary electrons, their degree of penetration will be lesser than the primary electrons of the beam. However, the scatter plate technique, to its credit, improves product uniformity by subjecting the target edges to increased electron exposure from the secondary electrons.

The prior art wedge magnet device illustrated in FIG. 3 consists of a scanning horn 30, wedge magnets 32 and window 33. Wedge magnets 32 are positioned along the scan horn base above window 33 and are powered by induction coils 34. The degree of electron deflection by magnets 32 corresponds to the height of the magnets. Hence, the deflection is greatest at the scan periphery. Once the primary electrons are deflected to possess an angle of incidence substantially normal to the plane of window 33 and target product 36, the electrons exit window 33 and enter air gap 38. The electrons scatter as represented by arrows 39 prior to impingement on target 36. Thus, a portion of the useful scattered electrons at the periphery of the scan will miss target 36 and a lesser dosage at the target edges will be observable.

Figure 4:
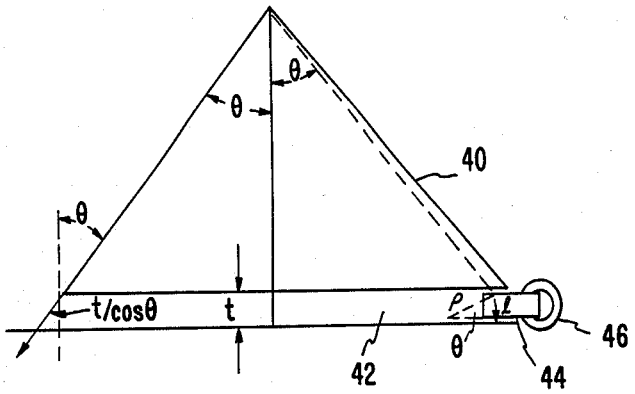
FIG. 4 is a geometric schematic of particle beam and an air gap magnet according to the invention.

Moving now to the instant invention, FIG. 4 is a geometrical schematic for illustrating the increase of apparent thickness of the window and air gap t with the degree of variation of angle $\theta$ from the perpendicular. The relationship of angular change to the apparent thickness is mathematically expressed by the equation $$t/\cos\theta = \text{apparent thickness}$$

After emerging at angle $\theta$ from window 42, the beam is subjected to a magnetic field generated from iron yoke 44 and induction coil 46. As a result, the primary beam electrons are deflected to normal and the scattered electrons are reoriented to impinge on the target edge.

Figure 5:
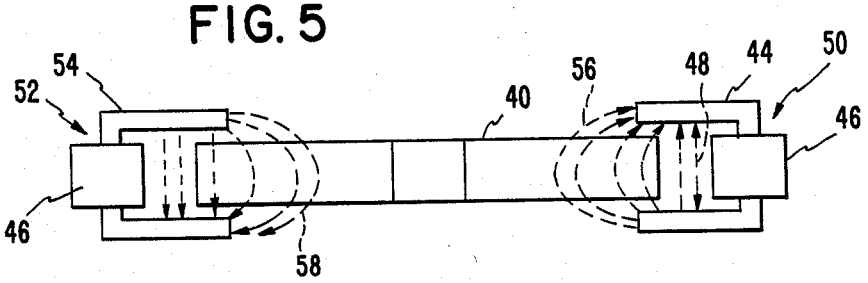
FIG. 5 is a top view of the invention with illustrative flux patterns.

Directing attention now to the structure of the invention, in FIG. 5, the spatial relationship of scan horn 40 with electro-magnet 50, iron yoke 44 and induction coil 46 is illustrated. Induction coil 46 is connected to an appropriate electrical current source (not illustrated). Yoke 44 features air gap 48, the width of which should exceed the width of the beam emerging from the scan window. Generally, the width of gap 48 should be approximately twice the width of the beam to encompass the primary and scattered electrons emerging from horn 40. Yoke 44 and like yoke 54 have a sufficient length and are positioned to underlie the peripheral edges of horn 40. By this arrangement, flux lines 56 and 58 are established between the arms and poles of yokes 44 and 54, respectively, where the highest flux density is achieved between the poles and yoke arms with diminishing magnetic force corresponding to the distance from the poles. Furthermore, to provide complementary and off-setting flux at the scan horn center, it is recommended that field forming electromagnets 50 and 52 be disposed to produce magnetic fields of opposite polarity as indicated by arrows 56 and 58.

Figure 6:
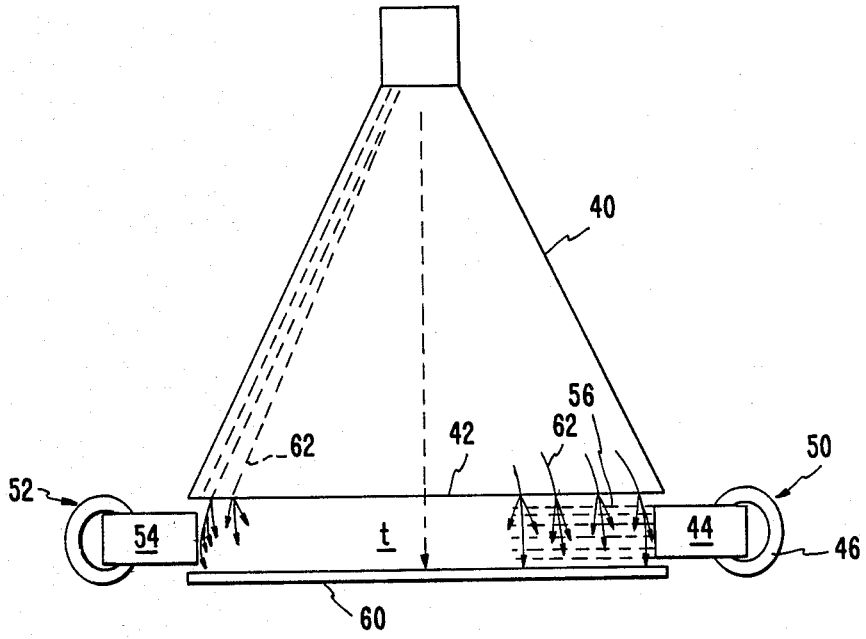
FIG. 6 is a front view of the invention with illustrative scatter patterns.

Moving now to FIG. 6, the spatial relationship between yoke electro-magnets 50 and 52 on the one hand, and scan horn 40 and target 60 on the other is represented. It should be evident to the skilled artisan that the physical configuration and design of induction coils 46 and magnet yokes 44 and 54 are related to the scan horn structure and the width of the electron beam. The beam width is governed by the beam energy, the window thickness and the height of the air space between window 42 and target 60. The width of beam 62 will increase as the energy declines due to increased scattering. As the beam energy declines, the width of field former electromagnet at air gap 48 should be increased and the height of yokes 44 and 54 varied to alter the electron path to achieve the desired degree of deflection of electrons 62. Since the intensity of flux density 56, 58 diminishes as a function of distance from the poles of yoke 44 as set forth above, the strongest magnetic field subsists between the yoke arms (poles) to induce maximum deflection. As depicted, the trajectories of electrons 62 closest to yokes 44 and 54, undergo the greatest angular realignment to become substantially normalized relative to the plane of target 60. Also, the scattered electrons with trajectories that would miss target 60, if unimpeded, are redirected into the edge of target 60.

There is a direct and quantifiable corresponding relationship between the degree of deflection of electrons 62 emerging from window 42 into airspace t, to the strength of the flux density. Mathematical treatment of the theory of this invention is now presented. The magnetic flux density (kilogauss per centimeter) varies relative to the electron beam energy, the window thickness and the scanning angle. It is expressed by equation $$\beta\rho[V(V+2V_o)]^{\frac{1}{2}}/kc \text{ kilogauss-cm} \quad (1)$$

where $\beta$= the flux density, in kilogauss required to bend the electrons through radius $\rho$ in centimeters V=electron kinetic energy ($10^5$–$10^7$ of electron volts)

$V_o$=rest energy of electrons=0.511 MeV c=velocity of light=$2.99\times10^8$ m/sec k=conversion constant=$10^{-9}$ conversion from TESLA-meters to kilogauss-cm From the foregoing equation, given the kinetic energy of the electrons, the magnetic flux force is easily determined. Table I represents the magnetic force necessary to deflect electrons of the stated energies.

TABLE I

| MeV | $\beta\rho$ kg-cm |
|---|---|
| 0.4 | 2.52 |
| 1.0 | 4.74 |
| 2.0 | 8.20 |
| 3.0 | 11.59 |
| 4.0 | 14.95 |
| 5.0 | 18.30 |

Knowing the required force to achieve the purpose of this invention, the structural parameters for field formers 50 and 52 can be mathematically ascertained. These parameters include the number of windings and current requirements of coils 46, the length of the air gap 48 and the height of yokes 44 and 54. The required inductance is expressible by equation $$NI=L_A\beta/0.4\pi \text{ (amperes per turn)} \quad (2)$$

where

N=number of turns of coil 46

I=current $L_A$=length of the magnet air gap 48, and $\beta$=flux density in the air gap in gauss.

The relationship of the scan angle, curvature of the electrons and deflection angle is defined by equation $$\rho = \frac{h}{\sin(\theta)} \quad (3)$$

where h =height of yokes 44 and 54

$\rho$=radius of curvature of the electrons $\theta$=angle of electron trajectory from normal Assigning appropriate values, as for example, electron energy of 0.4 MeV, a scan angle $\theta$ of 30°, a magnet yoke height of 7.5 cm, and an air gap length of 5 cm, equation 2 for NI is solvable:

$$\beta\rho = 2.52 \text{ kg/cm}$$

$$\rho = \frac{7.5 \text{ cm}}{\sin 30^\circ} = 15 \text{ cm}$$

-continued $$\beta = \frac{2.52}{15} = 0.168 \text{ kilogauss} = 168 \text{ gauss}$$

$$NI = \frac{5.0 \text{ cm}(168g)}{0.4\ \pi} = 668 \text{ ampere turns}$$

Detecting the position of the electron beam with respect to the ends of the scan and the control of the beam to maintain the desired effect/position over a variable electron beam energy range is now described.

Figure 7:
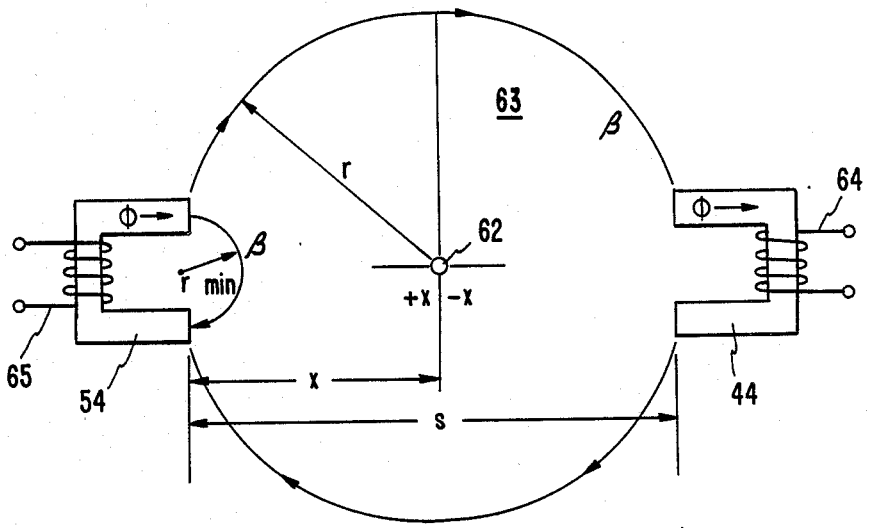
FIG. 7 is a representation of the magnetic flux fields established by use of the invention.

Referring to FIG. 7 and the description presented above, oscillating electron beam 62, generates its own magnetic field 63. As magnetic field 63 of the scanned electron beam 62 nears either iron cores 44 or 54, some of the magnetic flux 63 starts to flow through iron cores 44 or 54 with increasing induced voltage, the closer beam 62 moves toward iron cores 44 or 54. Since this flux is time varying, a voltage is induced in pickup windings 64 and 65. The induced voltage is also a function of the scan frequency of the beam, the number of turns on pickup windings 64 and 65 and the magnitude of magnetic flux 63.

Mathematically, magnetic flux 63 follows the Biot-Savart Law which is represented by $$\beta=0.2\mu I/r, \quad (4)$$

$\beta$=flux density in gauss $\mu$=permeability of the medium

I=current in amperes r=distance in centimeters from the electron beam to the point at which the flux is to be measured The induced voltage follows Lenz's Law. That is, whenever a flux changes relative to a coil, an electromotive force (emf) is induced in the coil, according to the formula:

$$e=-n(d\phi/dt)10^{-8} \text{ volts}, \quad (5)$$

where n =number of turns of the windings 64, 65

$\phi$=magnetic flux in the core t=time, seconds

Equation (5), modified to reflect the fact that the flux is non-linear as shown by Equation (4), presents the relationship between the flux $\phi$ in iron core 44 or 54 to the flux density $\beta$ as $$\phi=A\beta=0.2A\mu I/r, \quad (6)$$

where

A=area of iron core 44 or 54 in $cm^2$ that intercepts $\beta$

Taking the derivative of $\phi$ with respect to r $$d\phi/dr=-0.4A\mu I/r^2 \quad (7)$$

This equation permits r to be expressible as a function of the length of scan, the distance the beam moves from the center of the scanned beam and $r_{min}$. Since the beam is not allowed to intercept the pole faces of iron cores 44 or 54, r will have a minimum value which is expressed as $r_{min}$=radius from the center of the beam to the center of the iron core pole face.

The relationship is clearly illustrated when referring to FIG. 7

$$x=0.5s-r \text{ or } r=0.5s-x, \quad (8)$$

where s=scan length of the electron beam x=distance at any time of the center of the electron from the midpoint of the scanned beam length.

r=radius of the constant flux potential from the beam center to the pole faces of iron cores 44 or 54 ($r_{min}$)

Taking the derivative r with respect to x of Equation (8) and substituting it and the value of r in Equation (7)

$$r = 0.5s - x$$

$$dr = -dx$$

$$d\phi = 0.4A\mu I/(0.5s - x)^2\, dx \quad (9)$$

Following which Equation (9) is substituted in Equation (5), the result is $$e=-[0.4nA\mu I/(0.5s-x)^2]10^{-8}dx/dt. \quad (10)$$

For simplicity it is assumed that the rate of change of x with respect to t (dx/dt) is constant even though the velocity actually increases as the beam departs from the center of scan (where there is a constant angular velocity of the beam). This factor unnecessarily complicates the mathematical analysis while providing only a minimum contribution to the result. Hence, it is neglected for this analysis. Given the foregoing assumption $$dx/dt = 0.5s/0.25T = 2s/T = 2sf \quad (11)$$

where t=the time period T/4 required for the beam to move the distance x=0.5s.

T=the period of the frequency f of the scanned beam, T=1/f.

Substituting Equation (11) in Equation (10)

$$e=-[0.8nA\mu Isf/(0.5s-x)^2]10^{-8} \quad (12)$$

Induced voltage e, is now calculable from the rate of change of flux with time, whether increasing or decreasing, or the rate of change of motion of the electron beam, whether increasing or decreasing. Also, it should be appreciated that the voltage induced in windings 64 and 65 will always be such to oppose a change of flux. Therefore, when r is decreasing (x increasing), an increase of flux and increasingly negative voltage e results. Correspondingly, when r is increasing (x decreasing) with time, a decrease of flux and increasingly the positive voltage e results Given the foregoing mathematical formulations, an illustrative example is now provided. Assume that the following values are assigned to the following parameters n =100 turns A =7.5 cm$^2$, crossectional area of the iron yoke pole face I=0.1 amperes, electron beam s=180 cm. length of the scanned beam f=200 Hz, scan frequency r=values between 3 and 90 cm.

$\mu$=1 (air)

The calculated periodic values of e as a function of r are represented in Table II.

TABLE II

| r (cm) decreasing | x (cm) increasing | e (microvolts) |
|---|---|---|
| 30 | 60 | −24 |
| 20 | 70 | −54 |
| 10 | 80 | −216 |
| 5 | 85 | −864 |
| 3 | 87 | −2400 |
| **r (cm) increasing** | **x (cm) decreasing** | |
| 3 | 87 | 2400 |
| 5 | 85 | 864 |
| 10 | 80 | 216 |
| 20 | 70 | 54 |
| 30 | 60 | 24 |

Figure 8:
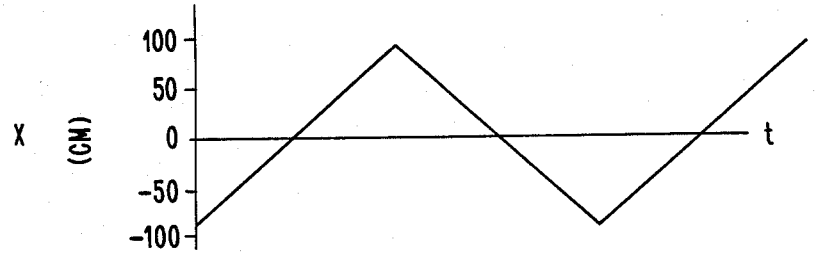
FIGS. 8 and 9 are graphic representations of flux induced by a sweeping electron beam in the invention as a function of distance and voltage over time, respectively.
Figure 9:
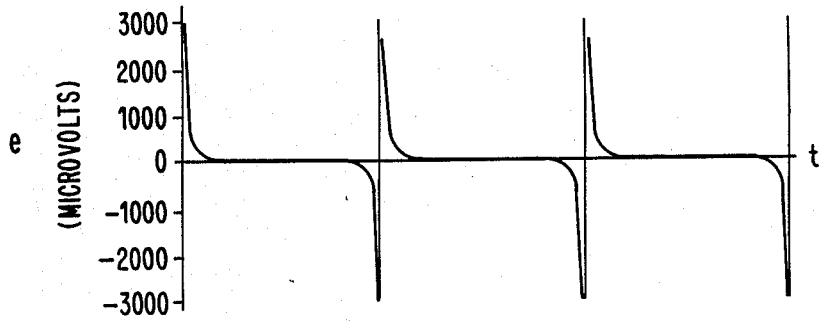

FIGS. 8 and 9 graphically represent values of distance x and voltage e plotted as a function of time. Although depicted in triangular wave form, minor contributing factors such as the assumption of constant velocity (identified above) as well as winding inductance and circuit resistance will moderate the abruptness of the directional charges.

Figure 10:
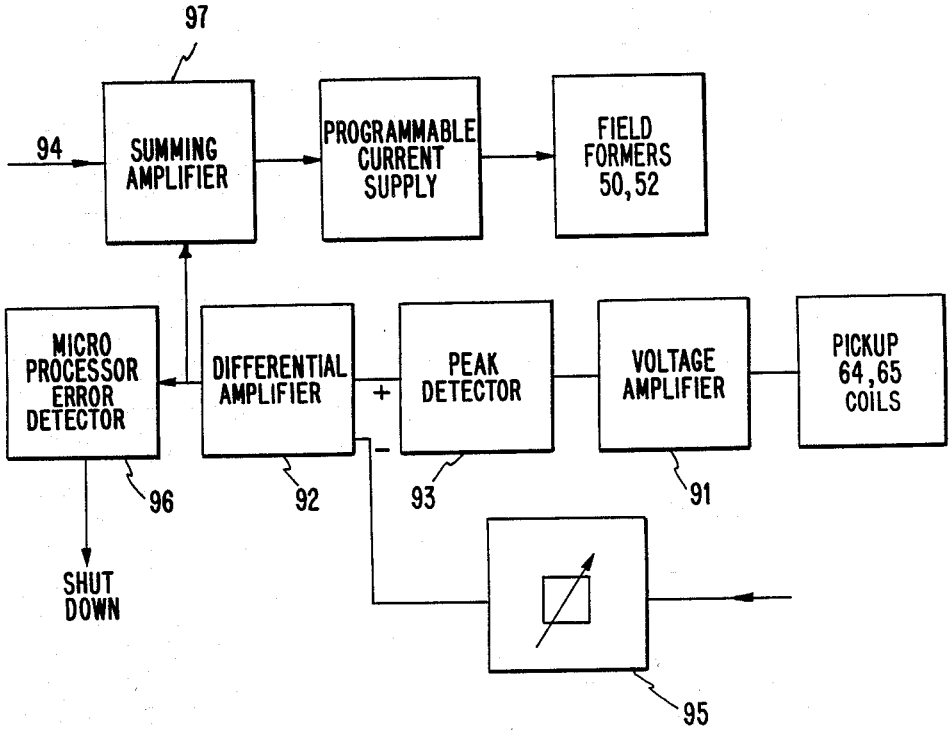
FIG. 10 is a schematic representation of an induced flux compensation controller according to this invention.

Moving now to FIG. 10, it illustrates a schematic representation of equipments designed for controlling the amount of magnetic field produced by the field former necessary to influence the electron beam at the lower energy. Furthermore, the equipments minimize the effect of the beam induced voltage on field formers 50, 52 at the higher energy to achieve acceptable scan uniformity. To achieve the desired effect for a particular situation, experimental determination is required. In this light, the following description and procedures may prove helpful.

First, as stated above, magnetic field formers 50 and 52 are physically set in place proximate to the ends of scan horn 40. The electron accelerator, then, is activated at minimum voltage and maximum beam current. The output of differential amplifier 92 is disconnected from summing point 97 and reference signal 94 is increased to obtain the desirable current for the field former whose magnetic field will affect the fringe field of the electron beam. Upon activation of the oscillating beam, a voltage of a determinable level in accordance with the foregoing is produced in coils 64 or 65. The voltage is amplified by voltage amplifier 91 and the voltage peak is detected by detector 93 and the corresponding signal fed to differential amplifier 92. Meanwhile, a feedback voltage proportional to beam current is passed through adjustment control 95; for instance, a variable resistor, to differential amplifier 92. The output of the differential amplifier is zeroed by adjusting the beam current feedback to eliminate any influence of the beam current changes on magnetic field 56, 58. The output is then reconnected to summing point 97 and the same signal is transmitted to microprocessor controller 96 for error detection recording and system shut down when the error exceeds a predetermined value.

As expressed above, and to illustrate the function of the controller, a change in the electron beam energy, such as an increase, will result in decreasing electron beam fringe field 63 and a corresponding decrease in pickup coil voltage 64, 65. This will result in a decrease of voltage from peak detector 93. Thus, the sum of differential amplifier 92 is smaller so that the output of amplifier 92 reduces the output of summing amplifier 97 causing the direct current (d.c.) output of the current supply to decrease magnetic field of the magnet field former 50, 52.

Magnetic field formers, in accordance with the foregoing, may be constructed for use in any number of situations once the proper calculations are performed to establish the flux density inductance requirements. Although it should be apparent, the skilled artisan is cautioned, as the foregoing equations do not contemplate a number of variables comprising minor contributions to the flux density generation. For example, the type of iron and its flux path length will affect the calculation. For purposes of simplicity, they are not treated mathematically due to their minimal contribution when contrasted with the considerably more substantial contributions set forth above.

Also, the above-defined equations do not account for the scattered electrons emerging from the scan horn window. Since rigid mathematical determination of their contribution would be extraordinarily complex, it is suggested that empirical determination of the scatter contribution for particular situations and structures be ascertained experimentally. To facilitate such determination, it is recommended that the starting point be based on $\theta$, the scan angle.

Having described the basic invention in detail, several structural embellishments should now be evident. For example, coils 64 and 65 may be the same as coils 46 since coils 46 are excited by direct current (d.c.) and the pick-up is alternating current (a.c.). The two currents are readily distinguished. Further, the electro-magnet field formers may be mounted on adjustable brackets for multidimensional position adjustment as well as easy removability and installation. Substitution and precise position of selected electro-magnets corresponding to the particular needs would be easily achieved. Also, series of coils possessing a different number of windings and interchangeable on the iron yokes may also be provided for substantial flux density adjustments. Finer magnetic flux force adjustments, of course, can be accomplished by employing adjustable power sources. A further modification contemplates shaping the pole faces of the iron cores to achieve fine tuning of the degree of electron beam deflection at the ends of the scan.

The above-described embodiment depicts an electron beam source. The skilled technician in this art should recognize the application of the invention to other charged particle beam scanning sources such as that described in U.S. Pat. No. 3,178,604 to Eklund as well as use with unscanned electron beams such as the electron curtain where the electrons pass normal to the window but scatter after emerging.

These and other variations and modifications of the invention should now be evident to the ordinary skilled artisan in this art. Therefore, such modifications and variations are contemplated to fall within the intent of the invention, the scope of which is defined by the following claims.

We claim:

1. A high energy charged particle apparatus for charged particle exposure of selected targets having outer edges, comprising:

generating means for generating a beam of charged particles, said generating means having a window;

two electro-magnetic deflecting means for deflecting the charged particles in the beam as they pass through the window, each of said electro-magnetic deflecting means possessing an air gap having a width greater than the width of the beam, said deflecting means being located between said window and the target at an equal distance from said window, being remotely spaced from each other and located substantially adjacent to the target edges, and being positioned to generate magnetic flux perpendicular to the particle beam for normalizing and deflecting scattered charged particles into the target.

2. A apparatus according to claim 1 where said magnetic deflecting means is a C-shaped iron yoke having two spaced poles forming said air gap therebetween and an induction coil.

3. A apparatus according to claim 2 where the magnet poles are positioned in a manner to induce maximum magnetic flux immediately proximate to the target edges.

4. A apparatus according to claim 3 where said charged particles are electrons and further including means for detecting and controlling the contribution of magnetic flux induced by said electron beam, means for sweeping the beam, and scanning horn with an electron permeable window where said electrons are swept in an oscillatory manner over a selected solid angle, thereby normalizing the angle of incidence of the electron beam across the solid angle.

5. A apparatus according to claim 4, including means for supporting the target located at a specified distance from said generating means and having a width equal to the width of said sweep angle.

6. A device for promoting uniform exposure of an elongated target having a specified width to a scanning electron beam, comprising:

means for producing a high energy electron beam including a scan horn, an electron permeable window, means for sweeping said electron beam over a specified angle defined by the ends of the scan horn, means for supporting the target at a specified distance from said window and where said target edges are spaced by a distance approximately equal to the scan horn width, thereby corresponding to the boundaries of said sweeping angle, magnetic field former means for generating magnetic flux transverse to said scan angle and parallel to said window where said flux is of maximum intensity at said target edges and progressively diminishes toward the center line of the target, said magnetic field former means being disposed substantially proximate to said target edges to deflect said electrons of said beam and to cause the angle of incidence of the electrons impinging on said target to be substantially uniform across said target surface.

7. A device according to claim 6 where said magnetic field forming means is a C-shaped magnet having two spaced poles forming an air gap therebetween and induction coil.

8. A device according to claim 6 where said magnetic deflecting means is a C-shaped magnet having two spaced poles forming an air gap therebetween and an induction coil where the magnet poles are positioned in a manner to induce maximum magnetic flux between said window and said target edges.

9. In combination:

a target, an electron beam source including a scan horn having a triangular configuration, an electron permeable window of specified length forming the horn base, scanning means for forming a scanning plane by sweeping a beam of electrons across the entire window length in an oscillatory manner, and two remote C-shaped electro-magnetic deflecting means for establishing a magnetic flux field transverse to said beam sweep and parallel to said window, said electro-magnetic deflecting means having poles and an air gap, the strength of said flux being greatest between the poles and of diminishing strength corresponding to the distance from said poles, said electro-magnetic deflecting means being separated by a distance less than the length of said window and disposed peripherally of said window where said electro-magnetic reflecting means normalizes the path of the electron beam and scattered electrons emerging from said window relative to the target.

10. A combination according to claim 9 where the magnet poles are positioned in a manner not to shadow any portion of the target and to induce maximum magnetic flux immediately above the target edges.

11. A magnetic field former for control of a charged particle beam, comprising:

a particle beam source for generating a particle beam said source including an electron permeable window, a power supply for supplying an electric current, a C-shaped magnetized yoke having two arms of a desired length separated by an air gap of a desired width and a base connecting said arms, said yoke being positioned proximate to said window and disposed substantially parallel to said window, an inductive coil comprised of a selected number of windings, said coil being electrically connected to said power supply and said coil being positioned around said base between said arms, a voltage amplifier to amplify voltage induced in said coil by said beam, a differential amplifier for generating a reference signal corresponding to the voltage induced by said particle beam in said coil, means for utilizing said signal to make adjustments based on said reference signal.

12. A charged particle apparatus for charged particle exposure of selected targets, comprising:

generating means for generating a beam of charged particles;

a window means for passing said beam to expose the entire target, electro-magnetic deflecting means for deflecting the charged particles in the beam and scattered by said window, said electro-magnetic deflecting means possessing an air gap having a width greater than the width of the beam, said deflecting means being located substantially adjacent and down stream of said window and being positioned to generate magnetic flux perpendicular to the plane of said particle beam to deflect and normalize the angle of incidence of the particles in said beam which are scattered by said window.

13. A apparatus according to claim 12 where said magnetic deflecting means is a C-shaped iron yoke having two spaced poles forming said air gap therebetween and an induction coil.

14. A apparatus according to claim 13 where said charged particles are electrons and further including means for detecting and controlling the contribution of magnetic flux induced by said electron beam, means for sweeping the beam and scanning horn with an electron permeable window where said electrons are swept in an oscillatory manner over a selected solid angle, thereby normalizing the angle of incidence of the electron beam across the solid angle.

15. In combination:

a high energy charged particle beam source including a scan horn, a permeable window of specified length forming the horn base, scanning means for forming a scanning plane by sweeping a beam of the particles across the entire window length in an oscillatory manner, and two remote C-shaped magnetic detecting means for detecting a magnetic flux field transverse to said beam sweep formed by said sweeping beam and parallel to said window, said electro-magnetic detecting means having poles, a base, defining an air gap and having inductive coil means disposed around said base, said magnetic detecting means being separated by a distance corresponding to the length of said window and disposed peripherally of said window, where the strength of said flux is greatest between the poles and of diminishing strength corresponding to the distance from said poles.

16. A high energy charged particle beam position detecting device, comprising:

a high energy charged particle source for generating an oscillating particle beam, a scanning horn associated with said source for confining the angular range of said beam oscillations between first and second sweep ends, said scanning horn including a particle permeable window and having a selected width, a first and a second remotely spaced detecting means each for producing an electric signal corresponding to the position of the beam within said horn, each of said detecting means being C-shaped and including a base surrounded at least in part by an inductance coil and two parallelly projecting arms defining an air gap therebetween substantially corresponding to the width of said horn, said first and second detecting means being positioned in a plane parallel to said window and said first detecting means located proximate to said first sweep end and said second detecting means is located proximate to said second sweep end, and a detector responsive to said electric signals, where sweeping of said beam generates a variable magnetic flux, the strength of which diminishes as a function of the distance of said beam from each of said detecting means.

17. A high energy charged particle beam position detecting device, comprising:

a high energy charged particle source for generating and oscillating a particle beam, a scanning horn associated with said source, said scanning horn including a particle permeable window, the angular range of said beam being confined to within the horn thereby defining the first and second ends of the beam scan, two remotely spaced detecting means for producing a current signal corresponding to the position of the beam within said horn, each of said detecting means including a base surrounded at least in part by an inductance coil and two arms where said means defines an air gap, said means being positioned proximate to and in a plane, said window and each of said means being positioned at the first and second ends of said beam scan, respectively, where oscillation of said beam generates a variable magnetic flux of a strength diminishing as a function of the distance of said beam from each of said detecting means.

18. A device according to claim 17 where said particles are electrons.

19. A method for detecting the position of an oscillating electron beam as it sweeps in an oscillatory manner through a scanning horn, with an electron permeable window with a detecting device featuring a C-shaped ferromagnetic yoke having a base and two parallelly extending arms therefrom and an inductive coil positioned around the base, the method comprising the steps of:

generating an electron beam, sweeping the beam in an oscillatory manner through the range of angles defined by the scanning horn thereby creating a magnetic field perpendicular to the plane of sweeping, locating the yoke proximate to the window where the arms of the yoke lie in a plane parallel to the magnetic field plane, generating an electric signal corresponding to the detected strength of the magnetic field in the yoke, determining the position of the beam according to the relationship of the distance of the beam from the arms of the yoke and the electric signal.

* * * * *